US008517097B2

(12) United States Patent
Segerstrom

(10) Patent No.: US 8,517,097 B2
(45) Date of Patent: Aug. 27, 2013

(54) SYSTEM AND METHOD FOR TRANSPORTING FLUIDS IN A PIPELINE

(75) Inventor: John A. Segerstrom, Oxnard, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 469 days.

(21) Appl. No.: 12/949,491

(22) Filed: Nov. 18, 2010

(65) Prior Publication Data

US 2011/0114340 A1 May 19, 2011

Related U.S. Application Data

(60) Provisional application No. 61/262,442, filed on Nov. 18, 2009.

(51) Int. Cl.

| | |
|---|---|
| ***E21B 43/00*** | (2006.01) |
| ***E21B 43/24*** | (2006.01) |
| ***E21B 43/243*** | (2006.01) |
| ***F17D 1/16*** | (2006.01) |
| ***F17D 1/18*** | (2006.01) |

(52) U.S. Cl.
USPC ..... 166/256; 137/13; 166/75.12; 166/244.1; 166/302; 166/369; 208/370

(58) Field of Classification Search
None
See application file for complete search history.

(56) References Cited

U.S. PATENT DOCUMENTS

| | | | | |
|---|---|---|---|---|
| 3,596,437 | A | 8/1971 | Styring, Jr. et al. | |
| RE27,309 | E * | 3/1972 | Scott et al. | 95/253 |
| 4,320,802 | A | 3/1982 | Garbo | |
| 4,560,467 | A * | 12/1985 | Stapp | 208/89 |
| 5,056,596 | A | 10/1991 | McKay et al. | |
| 2003/0024854 | A1 * | 2/2003 | Wen et al. | 208/209 |
| 2008/0217012 | A1 * | 9/2008 | Delorey et al. | 166/300 |
| 2009/0130482 | A1 | 5/2009 | Kocik et al. | |
| 2011/0000825 | A1 * | 1/2011 | McGrady et al. | 208/430 |
| 2012/0279902 | A1 * | 11/2012 | McGrady et al. | 208/134 |

OTHER PUBLICATIONS

PCT Search Report, PCT/US2010/057256, Jun. 10, 2011.

* cited by examiner

*Primary Examiner* — George Suchfield
(74) *Attorney, Agent, or Firm* — Craig R. Vander Ploeg

(57) ABSTRACT

A method of transporting carbon dioxide and crude oil in a pipeline is disclosed. The method includes providing supercritical carbon dioxide and heavy or extra heavy crude oil produced from a subterranean reservoir. The crude oil is mixed with the supercritical carbon dioxide to form a mixture having a viscosity less than the viscosity of the crude oil prior to mixing. The mixture is transported in a pipeline from a first location to a second location. The pipeline is maintained at sufficient pressures and temperatures such that any unsaturated carbon dioxide remains in a supercritical state while the mixture is transported through the pipeline.

20 Claims, 4 Drawing Sheets

SYSTEM AND METHOD FOR TRANSPORTING FLUIDS IN A PIPELINE

CROSS-REFERENCE TO RELATED APPLICATION

The present application for patent claims the benefit of U.S. Provisional Application for Patent bearing Ser. No. 61/262,442, filed on Nov. 18, 2009, the entirety of the application is incorporated herein by reference.

TECHNICAL FIELD

The present invention is generally directed to transportation of fluids in a pipeline, and more particularly, to a system and method for transporting a crude oil mixture in a pipeline.

BACKGROUND

Enhanced oil recovery processes, which are utilized to increase the amount of hydrocarbon production from a subterranean reservoir, are becoming common practice within the petroleum industry. One of the most frequently utilized enhanced oil recovery processes includes injecting a gas into the subterranean reservoir to displace the oil. Oil displacement is primarily achieved through mechanisms including oil swelling and viscosity reduction. For example, the injected gases are typically miscible with the lighter components of the crude oil such that as they mix, the composition or phase behavior of the crude oil is altered, thus improving the flowability of the oil. Application of such gas flooding techniques, however, has historically been limited due to the accessibility of nearby gas sources. For example, the gas to be injected into the reservoir typically needs to be transported from a production source. This may not prove to be economically feasible as sufficient gas sources are typically not adjacent to such reservoirs, especially ones which are substantially pure and available for direct use in an oil field.

Carbon dioxide is one of the gases predominantly employed for enhanced oil recovery gas flooding processes. Sufficient sources of carbon dioxide needed for such commercial exploitation typically include carbon dioxide producing facilities, fossil fuel combustion, and natural underground deposits. However, the costs associated with building a dedicated carbon dioxide producing facility at each oil field or constructing a high-pressure pipeline for transporting pure carbon dioxide to the reservoir field are often prohibitive. Additionally, carbon dioxide flooding processes have not proven to be beneficial in subterranean reservoirs containing heavy or extra heavy oils, as the gas typically does not develop any significant miscibility due to the lighter components of the crude oil not being present.

Subterranean reservoirs containing heavy or extra heavy oils, which generally have an API gravity of less than about 20 degrees API, therefore, often utilize a thermal recovery process to increase the amount of hydrocarbon production from the reservoir. By introducing heat into the reservoir, such as through steam injection or in-situ combustion, the viscosity of the oil is reduced sufficiently to allow the oil to flow towards producing wells. However, as previously described, such steam generation and combustion processes naturally produce carbon dioxide that can be captured to prevent its released into the atmosphere. Since it has not proven beneficial in heavy oil reservoirs to utilize the captured carbon dioxide in gas flooding processes, the carbon dioxide is typically transported elsewhere in a high pressure pipeline. For example, the carbon dioxide can be shipped to a carbon dioxide consumer, an underground storage facility, or a reservoir utilizing a gas flooding process. In some instances, depleted reservoirs can be utilized for carbon sequestration, which serves to mitigate the accumulation of greenhouse gases in the atmosphere.

While such carbon capture and storage techniques mitigate the potential impact on the environment, the costs associated with transporting the carbon dioxide can be prohibitive. In addition, once the heavy oil is produced from the reservoir, it still must undergo upgrading prior to shipment. Accordingly, diluents such as naphtha or synthetic crude oil are typically added to the heavy oil to reduce its viscosity such that it can be pumped with less difficulty.

It has been proposed to transport mixtures of crude oil and normally gaseous carbon dioxide such that the carbon dioxide acts as a diluent reducing the viscosity and pour point of the oil while being flowed through a pipeline. After transport, the carbon dioxide can then be separated from the crude oil. For example, U.S. Pat. No. 3,596,437 titled, "Use Of Carbon Dioxide In A Crude Oil Pipeline" discloses a method of transporting crude oil in a pipeline by mixing the crude oil with a fluid containing at least fifty percent by volume of carbon dioxide and less than ten percent by volume of ethane. As described in the specification of this patent, "At pipeline conditions, the fluid rich in carbon dioxide is a liquid and sufficiently soluble in the crude oil to accomplish a reduction in viscosity and pour point of the crude oil." See Column 1, Lines 61-63. Disclosed pipeline conditions include operating temperatures ranging from less than about −5 degrees Fahrenheit to about 70 degrees Fahrenheit and pipeline pressures below 500 p.s.i. (See Column 2, Line 73-Column3, Line 37).

As will be disclosed herein, Applicants propose a method for transporting a mixture of carbon dioxide and heavy oil in a pipeline under significantly different conditions.

SUMMARY

According to an aspect of the present invention, a method of transporting a mixture of carbon dioxide and crude oil in a pipeline is provided. The method includes providing crude oil having an API gravity of less than about 20 degrees API from a subterranean reservoir. Supercritical carbon dioxide is also provided. The crude oil and the supercritical carbon dioxide are mixed, and then transported in a pipeline from a first location to a second location. The mixture has a viscosity less than the viscosity of the crude oil prior to mixing. Unsaturated carbon dioxide is maintained in a supercritical state while transporting the mixture in the pipeline.

In one or more embodiments, the unsaturated carbon dioxide is maintained in a supercritical state by heating the mixture to a temperature above the critical temperature of carbon dioxide. For example, the mixture can be heated with a heater mechanism.

In one or more embodiments, the unsaturated carbon dioxide is maintained in a supercritical state by pressurizing the mixture to a pressure above the critical pressure of carbon dioxide. For example, the mixture can be pressurized using a booster pump.

In one or more embodiments, the unsaturated carbon dioxide is maintained in a supercritical state by heating and pressurizing the mixture to a temperature and pressure above the critical point of carbon dioxide.

In one or more embodiments, the carbon dioxide is produced as a by-product during one of steam generation and combustion processes of a thermal recovery process utilized in a subterranean reservoir for enhanced production of the crude oil. The carbon dioxide is then heated and pressurized into a supercritical state to form the supercritical carbon dioxide.

In one or more embodiments, the mixture formed by mixing supercritical carbon dioxide and crude oil has a viscosity below about 500 centipoise (cP) at pipeline temperatures and pressures. In one or more embodiments, the viscosity of the mixture is below about 350 cP at pipeline conditions. In one or more embodiments, the viscosity of the mixture is below about 250 cP at pipeline conditions.

In one or more embodiments, the mixture is separated at the second location to extract the heavy oil and the carbon dioxide.

In one or more embodiments, the length between the first location and the second location is at least 300 miles.

In one or more embodiments, the crude oil provided from the subterranean reservoir has an API gravity of less than about 10 degrees API.

According to another aspect of the present invention, a method of transporting a mixture of carbon dioxide and crude oil in a pipeline is disclosed. The method includes providing a crude oil having an API gravity of less than about 20 degrees API from a subterranean reservoir. Carbon dioxide is also provided, which is heated and pressurized into a supercritical state such that the carbon dioxide becomes supercritical carbon dioxide. The crude oil and the supercritical carbon dioxide are mixed to form a mixture having a viscosity less than the viscosity of the crude oil prior to mixing. The mixture is transported in a pipeline from a first location to a second location. A sufficient temperature and pressure is maintained within the pipeline such that unsaturated carbon dioxide remains in a supercritical state while transporting the mixture in the pipeline.

In one or more embodiments, the temperature within the pipeline is maintained above the critical temperature of carbon dioxide.

In one or more embodiments, the pressure within the pipeline is maintained above the critical pressure of carbon dioxide.

In one or more embodiments, the temperature within the pipeline is maintained above the critical temperature of carbon dioxide and the pressure within the pipeline is maintained above the critical pressure of carbon dioxide.

In one or more embodiments, the carbon dioxide is produced as a by-product during one of steam generation and combustion processes of a thermal recovery process utilized in a subterranean reservoir for enhanced production of the crude oil.

According to another aspect of the present invention, a method of transporting a mixture of carbon dioxide and crude oil in a pipeline is disclosed. The method includes providing a mixture formed by mixing supercritical carbon dioxide with a crude oil having an API gravity of less than about 20 degrees API. The mixture is transported in a pipeline from a first location to a second location. A sufficient temperature and pressure is maintained within the pipeline such that unsaturated carbon dioxide remains in a supercritical state while transporting the mixture in the pipeline.

In one or more embodiments, the temperature within the pipeline is maintained above the critical temperature of carbon dioxide.

In one or more embodiments, the pressure within the pipeline is maintained above the critical pressure of carbon dioxide.

In one or more embodiments, the temperature within the pipeline is maintained above the critical temperature of carbon dioxide and the pressure within the pipeline is maintained above the critical pressure of carbon dioxide.

DETAILED DESCRIPTION

Embodiments of the present invention described herein are generally directed to a system and method for transporting a mixture of carbon dioxide and heavy crude oil in a pipeline. As will be described herein in more detail, the system and method are specifically aimed at mixing supercritical carbon dioxide with crude oil, and transporting the mixture in a pipeline for long distances. Pumping stations maintain the pipeline at sufficient temperatures and pressures to maintain the flowability of the mixture through the pipeline. Accordingly, heavy oil and carbon dioxide can be transported in a pipeline from production sources to consumption sources at sufficient temperatures and pressures traversing several hundred or even several thousand miles. For example, crude oil and supercritical carbon dioxide can be mixed and transported in a pipeline running from Alberta, Canada to Texas.

Figure 1:
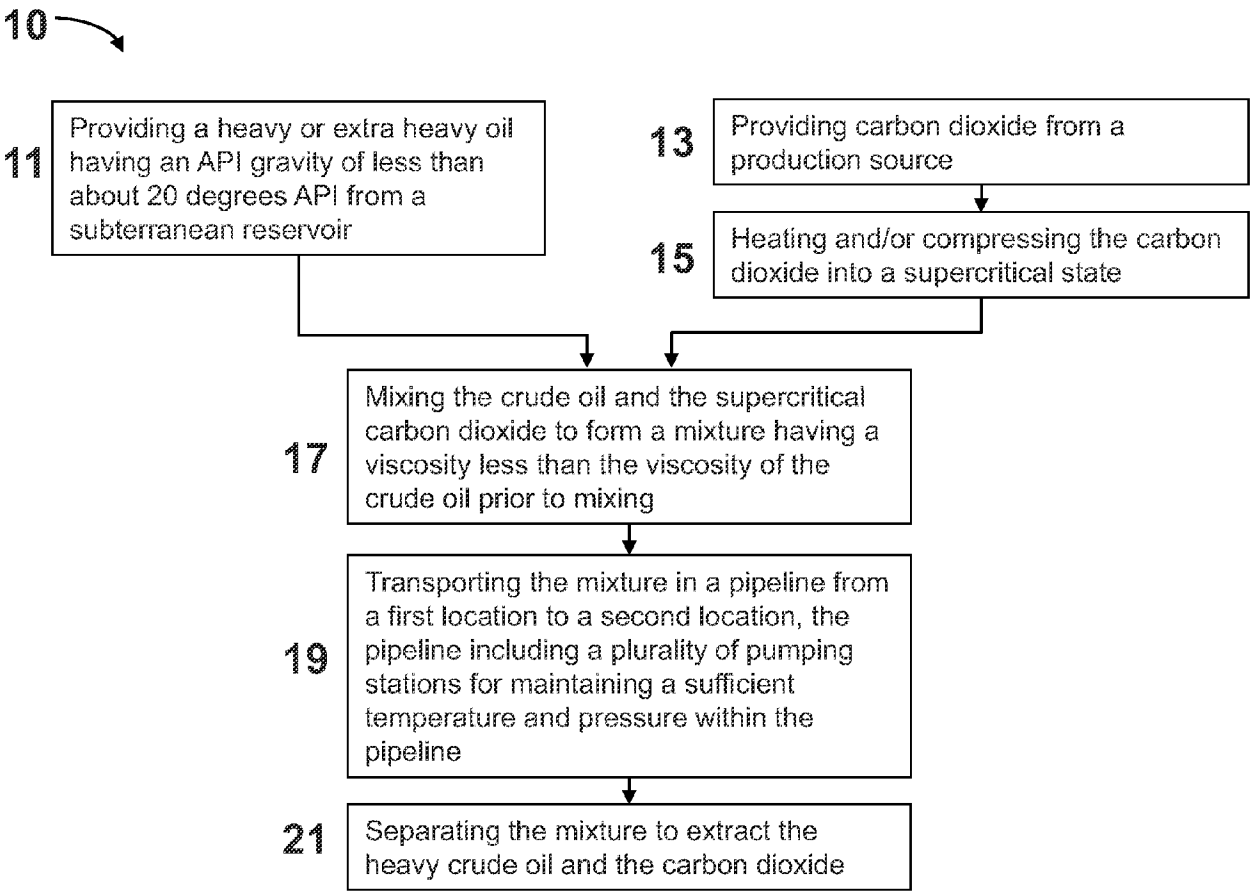
FIG. 1 is a flowchart illustrating steps for transporting a mixture of carbon dioxide and crude oil in a pipeline, in accordance with an embodiment of the present invention.

FIG. 1 is a flowchart that describes method 10 for transporting fluids in a pipeline according to an embodiment of the present invention. As will be described in more detail herein, method 10 includes providing crude oil having an API gravity of less than about 20 degrees API in step 11. As used herein, API gravity is the weight per unit volume of oil as measured by the American Petroleum Industries (API) scale. For example, API gravity can be measured according to the test methods provided by the American Society for Testing and Materials (ASTM) in test standard D287-92 (2006). Crude oil having an API gravity of less than about 20 degrees API is generally referred to as heavy oil. Crude oil having an API gravity of less than about 10 degrees API is generally referred to as extra heavy oil. In steps 13 and 15, supercritical carbon dioxide is provided. Carbon dioxide can be produced from a carbon dioxide production source in step 13. Step 15 of method 10 includes heating, compressing, or a combination thereof, the carbon dioxide into a supercritical state. The crude oil is mixed with the supercritical carbon dioxide in step 17 to obtain a mixture having a reduced viscosity compared to the viscosity of the crude oil provided in step 11. The mixture is transported in a pipeline in step 19, such as from a first location to a second location. A sufficient temperature and pressure is maintained within the pipeline to ensure flowability of the mixture. Unsaturated carbon dioxide is maintained in a supercritical state while transporting the mixture in the pipeline. As used herein, unsaturated carbon dioxide is carbon dioxide that is not dissolved in the crude oil. For example, if the saturation limit of the crude oil is met, excess carbon dioxide will not dissolve in the crude oil and will instead remain in a separate phase. Furthermore, because of the complex phase behavior of carbon dioxide and crude oil, the carbon dioxide may not completely dissolve in the crude oil. In some embodiments, the mixture is separated in step 21, such that the effluent crude oil and carbon dioxide can be utilized by respective consumption sources.

The heavy or extra heavy oil provided in step 11 is typically produced from a subterranean reservoir using a thermal recovery process. As previously described, heavy or extra heavy oils generally are very dense, have a heavier molecular composition, and higher viscosity than lighter crude oils. For example, a typical viscosity of bitumen produced from the Athabasca Oil Sands in Alberta, Canada is about 100,000 cP (centipoise) at about 300 degrees Kelvin. Another example of heavy or extra heavy oil reservoirs are Venezuela's Hamaca and Boscan fields. These reservoirs typically contain hydrocarbons with an API gravity of less than 22°, and typically hydrocarbons with an API gravity of less than 10°. Once the heavy or extra heavy oil has been extracted from the reservoir, it can be mixed with supercritical carbon dioxide in step 17. While not shown in FIG. 1, the crude oil can undergo conventional treatment processes such as crude dehydration and contaminate removal prior to mixing with the supercritical carbon dioxide in step 17.

The carbon dioxide provided in step 13 is typically produced from production sources such as dedicated producing facilities, fossil fuel combustion, and natural underground deposits. In some embodiments of the invention, carbon dioxide is captured as a by-product produced during steam generation and combustion processes of a thermal recovery process utilized in a subterranean reservoir for enhanced production of the heavy oil provided in step 11. The carbon dioxide provided in step 13 is heated, compressed, or a combination thereof, in step 15 such that it is placed in a supercritical state. As previously described, it is then mixed with the crude oil in step 17 such that it can be transported in a pipeline.

Figure 2:
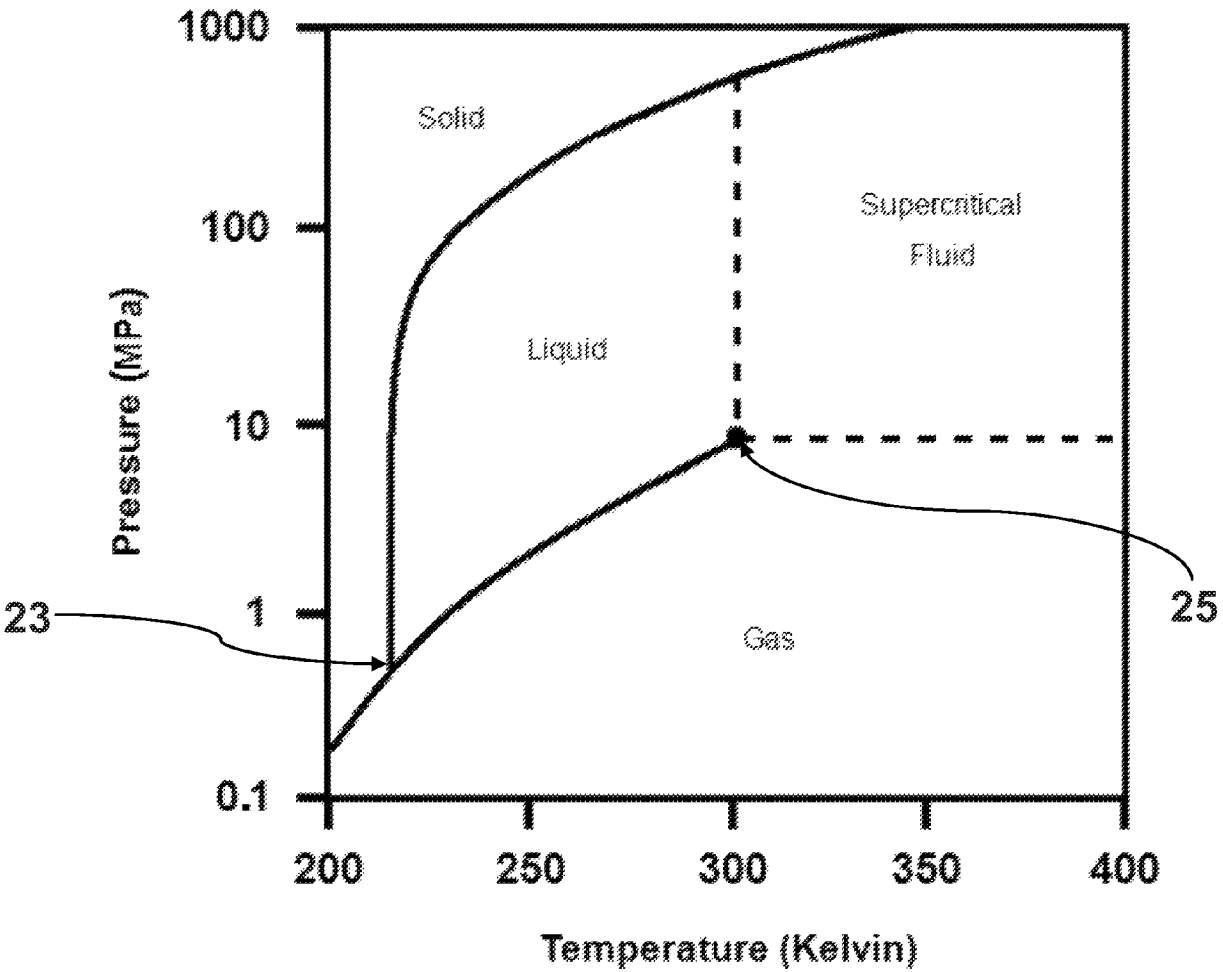
FIG. 2 is a pressure-temperature phase diagram for carbon dioxide.

FIG. 2 shows a temperature-pressure phase diagram for pure carbon dioxide. Within the areas separated by each solid line or curve, the pressure and temperature only allow carbon dioxide to exist in a single phase (e.g., solid, liquid, or gas). For example, variations in temperature and pressure within each area will not alter the phase. However, at any point on the curves the temperature and pressure allow the carbon dioxide to exist in two phases in equilibrium—solid and liquid, solid and vapor, or liquid and vapor. Furthermore, the junction of the three curves, commonly referred to as the triple point 23, represents the unique condition for carbon dioxide such that it exists in equilibrium together under all three phases. Additionally, the point at which the vaporization curve (i.e., liquid-gas curve) ends, is commonly referred to as the critical point. Critical point 25 in FIG. 2 represents the generally accepted minimum pressure or temperature needed for carbon dioxide to transition into a supercritical state. There is not a definite phase transition into the supercritical regime such that near critical point 25 the liquid and vapor become indistinguishable. However, small changes in pressure or temperature around critical point 25 typically result in large changes in the properties of carbon dioxide such as its density. In order for pure carbon dioxide to reach a supercritical state, it must be heated, pressurized, or a combination thereof, above its critical temperature or pressure. The generally accepted critical temperature of carbon dioxide is 304.1 degrees Kelvin (87.7° F.) and the generally accepted critical pressure of carbon dioxide is 7.38 MPa (1070.4 p.s.i).

In step 17 of method 10, the crude oil provided in step 11 is mixed with the supercritical carbon dioxide that was placed into a supercritical state in step 15 to obtain a mixture having a reduced viscosity. For example, the typical viscosity of bitumen produced from the Athabasca Oil Sands in Alberta, Canada is about 100,000 cP (centipoise) at 300 degrees Kelvin. As the supercritical carbon dioxide blends with the heavy oil, the specific gravity and viscosity of the produced mixture are reduced such that its surface tension effects diminish, thus improving its flowability. In one embodiment, the mixture of supercritical carbon dioxide and crude oil produced in step 17 has a viscosity below about 500 cP at pipeline conditions. In another embodiment, the viscosity of the mixture produced in step 17 is below about 350 cP at pipeline conditions. In another embodiment, the viscosity of the mixture produced in step 17 is below about 250 cP at pipeline conditions.

Figure 3:
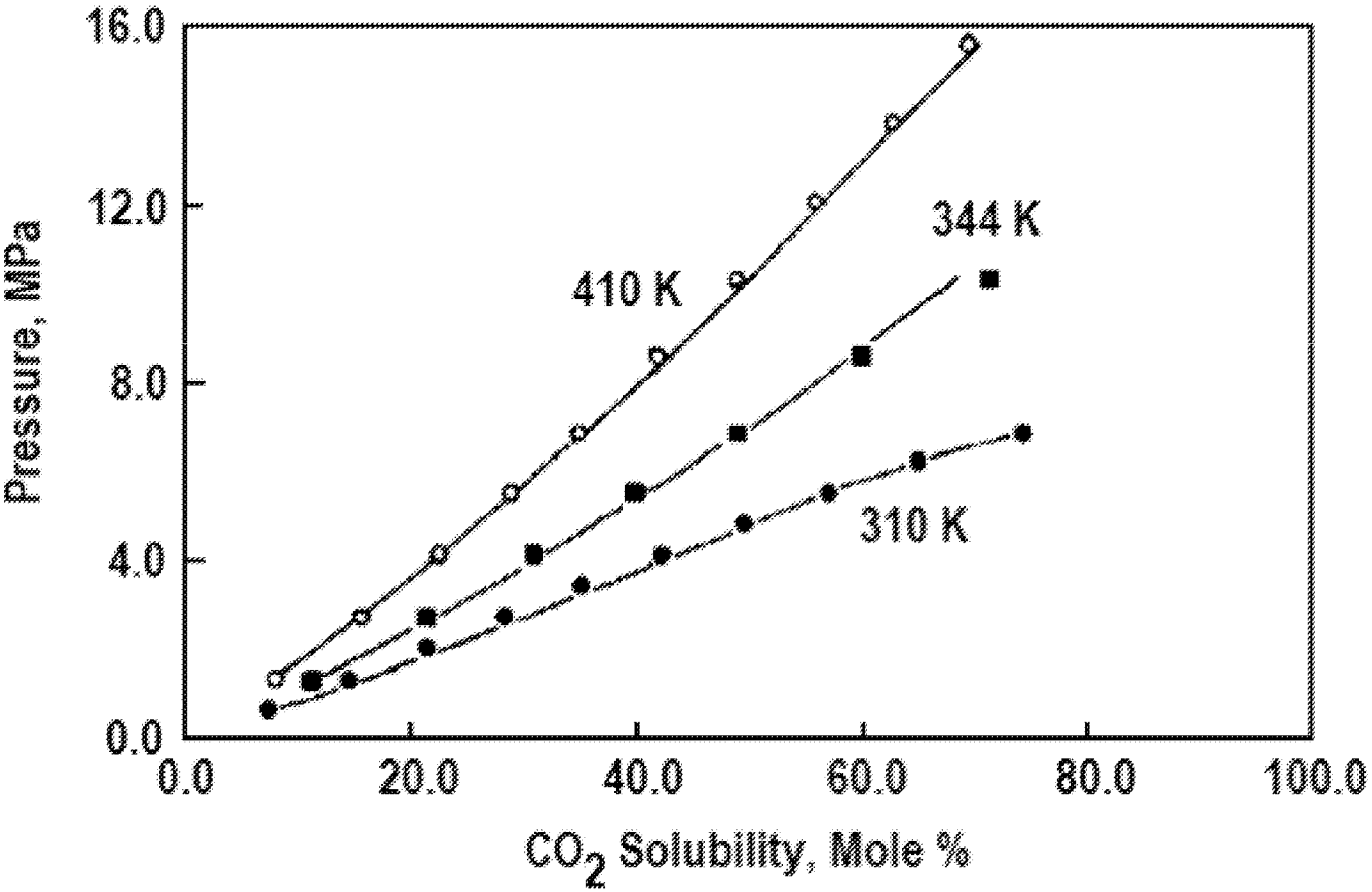
FIG. 3 is a graph showing the solubility of carbon dioxide in crude oil.

One skilled in the art will appreciate that the viscosity of carbon dioxide saturated heavy oil at high pressures (e.g., above 3.5 MPa) is largely influenced by the temperature of the mixture, such that as the temperature is increased the viscosity is reduced. Similarly, the viscosity of carbon dioxide saturated heavy oil at elevated temperatures (e.g., above 300 degrees Kelvin) is largely influenced by the pressure of the mixture, such that as the pressure is increased the viscosity is reduced. The solubility of carbon dioxide in crude oil generally increases with pressure and decreases with temperature. For example, if the mixture is at equation-of-state (EOS) equilibrium and then cools, the carbon dioxide will be under saturated in the crude oil. FIG. 3 is a graph showing the solubility of carbon dioxide in crude oil as a function of temperature and pressure, which is a reproduced version of that published by A. K. M. Jamaluddin, N. E. Kalogerakis, and A. Chakma in Predictions of CO2 solubility and CO2 saturated liquid density of heavy oils and bitumens using a cubic equation of state, *Fluid Phase Equilibrium, Vol.* 63, pg. 33-48 (1991).

The ratio of supercritical carbon dioxide to heavy oil also can influence properties of the mixture. For example, adding supercritical carbon dioxide until reaching the saturation limit typically reduces the viscosity of the mixture. In one embodiment, crude oil provided in step 11 is mixed with the supercritical carbon dioxide of step 15 at a ratio of about 9 pounds of crude oil to about one pound of supercritical carbon dioxide. At a pressure of 8.0 MPa (1160 p.s.i) and a temperature of 308.0 degrees Kelvin (95.0° F.), the density of supercritical carbon dioxide is about 0.43 grams per cubic centimeter ($g/cm^3$). Using a density of 1.0856 $g/cm^3$ for crude oil, the volume ratio of carbon dioxide to crude oil is about 0.28.

The mixture produced by mixing supercritical carbon dioxide and crude oil are transported from a first location to a second location in step 19. In some embodiments, the first location is located in close proximity to either the subterranean reservoir in which the crude oil is produced or a carbon dioxide production source. In some embodiments, the second location is located in close proximity to an oil refinery or a carbon dioxide consumption source. During transport of the mixture, the mixture within the pipeline is kept at sufficient temperatures and pressures. For example, excess or unsaturated carbon dioxide is typically maintained in a supercritical state while transporting the mixture in the pipeline. In some embodiments, the mixture is separated in step 21 such that the extracted crude oil and carbon dioxide can be readily utilized by their respective consumption sources.

Figure 4:
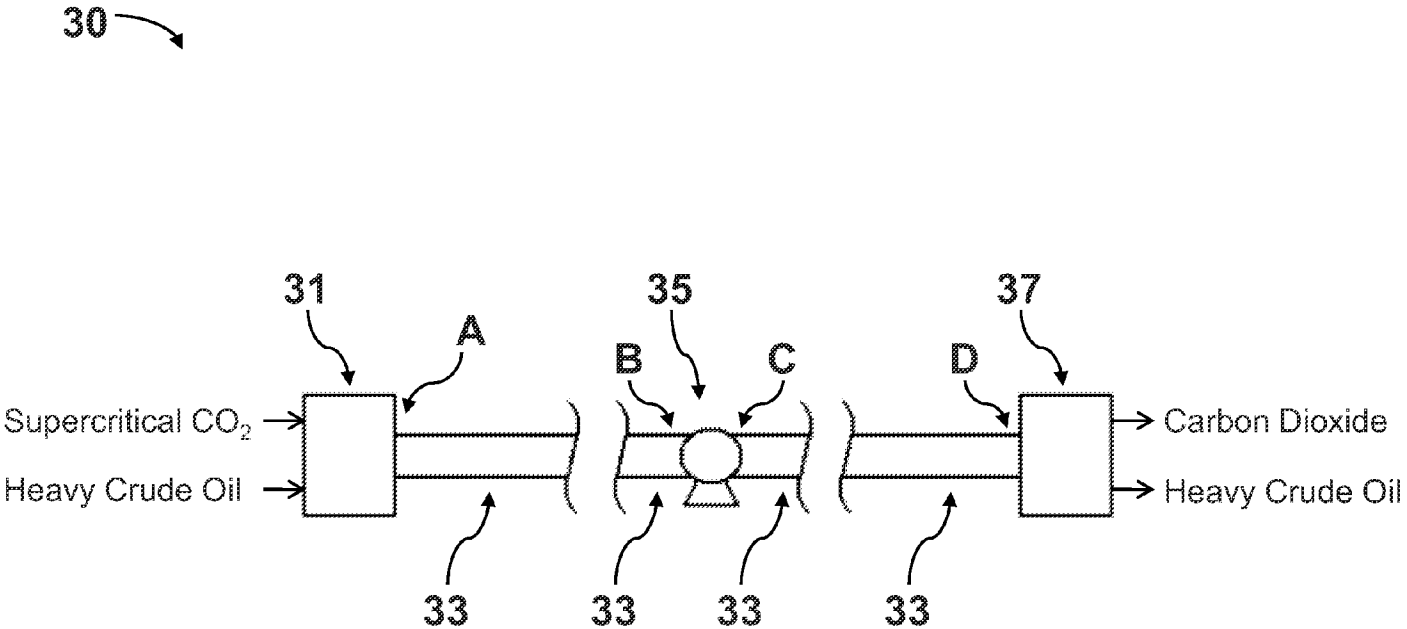
FIG. 4 is a schematic diagram of a system used for transporting a mixture of carbon dioxide and crude oil, in accordance with an embodiment of the present invention.

FIG. 4 is a schematic of pipeline system 30 used in method 10. The supercritical carbon dioxide and heavy oil are mixed in mixing device 31 according to step 17 of method 10. Mixing device 31 can be any type of mixing and shearing equipment. For example, mixing device 31 can include dynamic mixers such as turbine, batch, or planetary mixers, static mixers, single or multiple screw extruders, colloid mills, homogenizers, or sonolators. In some embodiments, mixing device 31 can include a plurality of mixing and shearing equipment devices to decrease the time needed to blend the supercritical carbon dioxide and heavy oil. Mixing device 31 is fluidly connected to pipeline 33 such that the mixture of carbon dioxide and crude oil passes through mixing device 31 into pipeline 33 at pipeline junction A.

One or more pumping stations 35 are fluidly connected to pipeline 33 such that the mixture of carbon dioxide and heavy oil travels from the pipeline into the pumping station 35 at pipeline junction B. The mixture of carbon dioxide and crude oil is heated, compressed, or a combination thereof, within pumping station 35, and then exits pumping station 35 at pipeline junction C back into pipeline 33. Pumping stations 35 are spaced along pipeline 33 to minimize the temperature and pressure loss of the mixture as it is transported within pipeline 33. For example, pressure drop in a pipeline mainly occurs due to friction between the flowing mixture and the internal surface of the pipeline, but also occurs during passage through valves and fittings. Similarly, temperature loss in a pipeline can occur where the pipeline is poorly insulated and exposed to the external environment such as when a pipeline passes through rivers, expansion loops, or other heat sinks where heat can rapidly dissipate.

Pumping stations 35 are strategically placed a predetermined distance apart from each other such that the pressure and temperature in the pipeline does not drop below predetermined threshold values. In one or more embodiments, the pressure and temperature is sufficiently maintained such that unsaturated carbon dioxide remains in a supercritical state while transporting the mixture in the pipeline. For example, the unsaturated carbon dioxide can be maintained in a supercritical state by heating the mixture to a temperature above the critical temperature of carbon dioxide. In another example, the unsaturated carbon dioxide is maintained in a supercritical state by pressurizing the mixture to a pressure above the critical pressure of carbon dioxide. In another example, the unsaturated carbon dioxide is maintained in a supercritical state by heating and pressurizing the mixture to a temperature and pressure above the critical point of carbon dioxide.

In one or more embodiments, the temperature in the pipeline is maintained above about 300 degrees Kelvin. In one or more embodiments, the temperature in the pipeline is maintained above about 325 degrees Kelvin. In one or more embodiments, the pressure in the pipeline is maintained above about 3.5 MPa. In one or more embodiments, the pressure in the pipeline is maintained above about 5 MPa. In one or more embodiments, the pressure in the pipeline is maintained above about 7 MPa.

Pumping stations 35 can include heater mechanisms such as a direct fire heater (natural gas or combustible fuel) to maintain the temperature of the mixture as it travels within the pipeline, intermediate booster pumps to maintain the fluid pressure within the pipeline, or a combination thereof. While sufficient pressure and temperatures must be maintained in the pipeline to maintain flowability of the mixture, the distance between pumping stations 35 can vary based upon the design of pipeline system 30. For example, sufficient pipeline pressure can be achieved by balancing the distance between pumping stations 35 with the power ratings of the pumping mechanisms. Similarly, sufficient pipeline temperature can be achieved by balancing the amount of pipeline insulation with the outputs of the heater mechanisms. Additionally, the pressure and temperature can be greatly affected by the pipe size of pipeline 33. Such design factors are typically determined through evaluation of capital costs and projected operating expenses of pipeline system 30. In one embodiment, a pipeline running from Alberta, Canada to Texas, pumping stations 35 are placed within 100 miles from each other.

When the mixture reaches its destination, it enters separation device 37, which is fluidly connected to pipeline 35 at pipeline junction D. The mixture is depressurized within separation device 37, which allows for separation of the carbon dioxide and crude oil. Separation device 37 may utilize various separation items, already known in the art, to assist in separating the mixture of carbon dioxide and crude oil. For example, separation device 37 can include a cyclone, a plurality of spaced baffles, a chemical demulsifying agent, or a chemical settling agent to accelerate the separation of the carbon dioxide and crude oil.

The effluent carbon dioxide can then be utilized by a carbon dioxide consumption source and the effluent crude oil can be used by a hydrocarbon consumption source. For example, the effluent carbon dioxide can be injected into a subsurface formation in an enhanced oil recovery process or be injected into a saline aquifer. Similarly, the extracted crude oil can be delivered to a hydrocarbon refinery or upgrading facility.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What is claimed is:

1. A method of transporting a mixture of carbon dioxide and crude oil in a pipeline, the method comprising:

(a) providing a crude oil having an API gravity of less than about 20 degrees API from a subterranean reservoir;

(b) providing supercritical carbon dioxide;

(c) mixing the crude oil with the supercritical carbon dioxide to form a mixture having a viscosity less than the viscosity of the crude oil prior to mixing;

(d) transporting the mixture in a pipeline from a first location to a second location; and (e) maintaining unsaturated carbon dioxide in a supercritical state while the mixture is being transported in step (d).

2. The method of claim 1, wherein in step (e) the mixture is heated above a temperature at which carbon dioxide transitions into a supercritical state.

3. The method of claim 1, wherein in step (e) the mixture is pressurized above a pressure at which carbon dioxide transitions into a supercritical state.

4. The method of claim 1, wherein in step (e) the mixture is heated and pressurized above a temperature and pressure at which carbon dioxide transitions into a supercritical state.

5. The method of claim 1, wherein the mixture contains about 1 pound of the supercritical carbon dioxide for every 9 pounds of the crude oil.

6. The method of claim 1, wherein the supercritical carbon dioxide is formed by:

producing carbon dioxide as a by-product of steam generation of a thermal recovery process utilized in a subterranean reservoir for enhanced production of the crude oil; and heating and pressurizing the carbon dioxide into a supercritical state.

7. The method of claim 1, wherein the supercritical carbon dioxide is formed by:

producing carbon dioxide as a by-product of combustion processes of a thermal recovery process utilized in a subterranean reservoir for enhanced production of the crude oil; and heating and pressurizing the carbon dioxide into a supercritical state.

8. The method of claim 1, wherein the mixture has a viscosity below about 500 centipoise at pipeline temperatures and pressures.

9. The method of claim 1, wherein the crude oil has an API gravity of less than about 10 degrees API.

10. The method of claim 1, further comprising:

(f) separating the mixture at the second location to extract the heavy oil and the carbon dioxide.

11. The method of claim 1, wherein the length between the first location to the second location is at least 300 miles.

12. A method of transporting a mixture of carbon dioxide and crude oil in a pipeline, the method comprising:

(a) providing a crude oil having an API gravity of less than about 20 degrees API from a subterranean reservoir;

(b) providing carbon dioxide;

(c) heating and pressurizing the carbon dioxide into a supercritical state such that the carbon dioxide is supercritical carbon dioxide;

(d) mixing the crude oil with the supercritical carbon dioxide to form a mixture having a viscosity less than the viscosity of the crude oil prior to mixing;

(e) transporting the mixture in a pipeline from a first location to a second location; and (f) maintaining a sufficient temperature and pressure within the pipeline such that unsaturated carbon dioxide remains in a supercritical state while transporting the mixture in the pipeline.

13. The method of claim 12, wherein the temperature within the pipeline is maintained above a temperature at which carbon dioxide transitions into a supercritical state.

14. The method of claim 12, wherein the pressure within the pipeline is maintained above a pressure at which carbon dioxide transitions into a supercritical state.

15. The method of claim 12, wherein the temperature and pressure within the pipeline is maintained above a temperature and pressure at which carbon dioxide transitions into a supercritical state.

16. The method of claim 12, wherein the carbon dioxide provided in step (b) is produced as a by-product during one of steam generation and combustion processes of a thermal recovery process utilized in the subterranean reservoir for enhanced production of the crude oil.

17. A method of transporting a mixture of carbon dioxide and crude oil in a pipeline, the method comprising:

(a) providing a mixture formed by mixing supercritical carbon dioxide with crude oil having an API gravity of less than about 20 degrees API;

(b) transporting the mixture in a pipeline from a first location to a second location; and (c) maintaining a sufficient temperature and pressure within the pipeline such that unsaturated carbon dioxide remains in a supercritical state while transporting the mixture in the pipeline.

18. The method of claim 17, wherein the temperature within the pipeline is maintained above a temperature at which carbon dioxide transitions into a supercritical state.

19. The method of claim 17, wherein the pressure within the pipeline is maintained above a pressure at which carbon dioxide transitions into a supercritical state.

20. The method of claim 17, wherein the temperature and pressure within the pipeline is maintained above a temperature and pressure at which carbon dioxide transitions into a supercritical state.

* * * * *